United States Patent [19]

Pupp

[11] 4,301,939

[45] Nov. 24, 1981

[54] RECLOSABLE PACKING CONTAINER

[75] Inventor: Herwig Pupp, Lund, Sweden

[73] Assignee: Tetra Pak International AB, Lund, Sweden

[21] Appl. No.: 89,475

[22] Filed: Oct. 30, 1979

[30] Foreign Application Priority Data

Nov. 6, 1978 [SE] Sweden ..... 7811432

[51] Int. Cl.[3] ..... B65D 17/30

[52] U.S. Cl. ..... 220/267; 220/279; 220/307; 206/616; 229/5.6

[58] Field of Search ..... 220/265-270, 220/279, 307, 280; 206/616, 617, 620, 621; 215/253, 256, 257; 229/5.6

[56] References Cited

U.S. PATENT DOCUMENTS

| | | | |
|---|---|---|---|
| 2,350,871 | 6/1944 | Bogner | 220/267 |
| 3,580,481 | 5/1971 | Koboldt | 206/617 |
| 3,615,034 | 10/1971 | Lemelson | 220/267 |
| 4,006,839 | 2/1977 | Thiel et al | 220/266 |
| 4,207,989 | 6/1980 | Ingemann | 220/266 |

FOREIGN PATENT DOCUMENTS 7413152 10/1974 Sweden .

*Primary Examiner*—George T. Hall

*Attorney, Agent, or Firm*—Burns, Doane, Swecker & Mathis

[57] ABSTRACT

Cup-shaped packing containers are used for the packaging of e.g. yoghurt. The packing containers are provided with lids which can be removed from the packing container in that e.g. the seal between lid and cup portion is broken. After opening the lid cannot be used for the reclosure of the packing container.

This is a disadvantage, which is overcome in accordance with the invention, in that the lid is adapted so that it fits closely against the inside of the cup portion in an area situated below the line along which on opening of the packing container the lid is intended to be separated from the cup portion. By an appropriate dimensioning of the lid and the cup portion the lid can be retained by and seal the cup portion after the opening, which is an advantage if a part of the contents is to be saved for later consumption.

8 Claims, 5 Drawing Figures

RECLOSABLE PACKING CONTAINER

The present invention relates to a reclosable packing container comprising a container body provided with a base and a lid applied to the upper end which is adpated so that it can be separated from the container body along an opening indication line extending round the upper part of the same.

Cup-shaped packing containers of the non-returnable type are used inter alia for the packaging of a large number of different types of liquid foodstuffs, e.g. juice, milk, yoghurt, etc. Usually, the packing containers are manufactured in sizes which make them suitable as portion packages for the different foodstuff products, but larger packages are also produced.

A known cup-shaped packing container of the non-returnable type is manufactured from a laminated material which comprises a central layer of foamed plastics, covered on either side by a homogeneous layer of thermoplastic material. Such a packing container is described in Swedish Pat. No. 381,442 to which reference is made. The packing container comprises a lid which is made of the same material as the packing container and is joined by heat-sealing to the free top rim of the packing container. To facilitate the opening of the packing container the container body comprises a tearing thread situated in the vicinity of the said top rim. This tearing thread is attached to the inner layer of the laminated packing material and extends all round the container body at some distance below the top rim of the container body joined to the lid. One end of the tearing thread projects from the wall of the packing container and can thus be gripped from the outside when the packing container is to be opened.

The non-returnable package described above is easy to open and designed in such a manner that a wholly or partly opened packing container indicates that the packing container is no longer unopened, since the lid has been partly separated from the packing container and cannot be replaced onto the same in such a manner that the attempted opening that has taken place can be concealed. This is particularly desirable in the case of foodstuff packages, since a not completely tight packing container frequently can give rise to a deterioration of quality or shortened keeping properties of the packed product which, if it is not discovered before consumption, may represent a health hazard.

In the packaging of foodstuffs which are not consumed "immediately" after opening of the packing container, it is moreover desirable for reasons of hygiene that it should be possible to reclose the packing container with the help of the packing container lid. This, however, has not been possible up to now in the known cup-shaped packing containers of the non-returnable type. A lid which combines reclosability with a design which indicates attempted opening is fairly complicated and expensive and is, therefore, not suitable for the relatively cheap non-returnable packages. In the case of more expensive packing containers the problem has usually been solved in that the packing container was provided with two different lids, one lid indicating whether the packing container has been opened or not and another one lid intended only for reclosure. Generally in such cases a foil covering the opening of the packing container is used together with a snap-action lid, located above or below the same. This solution is expensive, however, and is not appropriate therefore for non-returnable packages used for example for milk, yoghurt or the like.

Thus, it is generally desirable to furnish a lid of simple design and at relatively low cost which in itself combines the two properties of being reclosable and of indicating an attempted opening.

It is also desirable that the lid should be of such a design that it is suitable for automatic manufacture and application.

Thus it is the object of the present invention to furnish a reclosable packing container comprising a lid which achieves the above mentioned ends without being affected by the disadvantages of earlier designs.

A special object is furthermore to furnish a reclosable lid of the abovementioned type which is particularly adapted so that it can be used together with the packing container described in Swedish Pat. No. 381,442.

These objects have been achieved in accordance with the invention in that a reclosable packing container comprising a container body provided with a base and a lid applied to its upper end, which is adapted so that it can be separated from the container body along an opening indication line extending round the upper part of the same, has been given the characteristic that the lid fits closely against the inside of the container body in an area situated below the opening indication line. In this way the lid can be replaced onto the packing container after opening, the circumstance of the lid fitting closely against the inside of the container body ensuring that the lid is guided and retained in place in the upper end of the container body.

A preferred embodiment of the packing container in accordance with the invention has been given the further characteristic that the lid is sealed in a liquid-tight manner to the container body in an area situated above the opening indication line extending round the upper end of the container body.

A further embodiment of the packing container in accordance with the invention has been given further characteristic that the lid is provided with a ridge fitting against the inside of the container body.

A further embodiment of the packing container in accordance with the invention has been given the further characteristic that the container body in its upper part has an internal ridge which is located below the opening indication line and adapted to form a snap-action closing device for the lid.

A further embodiment of the packing container in accordance with the invention has been given the further characteristic that the lid has a recessed centre portion whose outside dimension substantially corresponds to the inside dimension of the upper parts of the container body.

A further embodiment of the packing container in accordance with the invention has been given the further characteristic that the opening indication line comprises a tearing thread which is applied to the inside of the container body.

A further embodiment of the packing container in accordance with the invention has been given the further characteristic that the lid edge is in the form of a flange which is partly folded down against and is sealed to the top rim of the container body.

A further embodiment of the packing container in accordance with the invention has been given the further characteristic that the upper end portion of the container body as well as the recessed part of the lid are cylindrical.

A further embodiment of the packing container in accordance with the invention has been given the further characteristic that the lid as well as the container body are manufactured from a thermoplastic, flexible material.

A further embodiment of the packing container in accordance with the invention finally has been given the characteristic that the packing container is manufactured from foamed plastic material which on both sides is laminated with a liquid-tight homogeneous plastic layer.

A preferred embodiment of the reclosable packing container in accordance with the invention will now be described in detail with special reference to the enclosed schematic drawing which only shows the parts required for an understanding of the invention.

Figure 3:
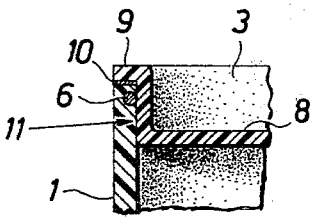
FIG. 3 shows on a larger scale a part of the packing container in accordance with FIG. 2 and illustrates in greater detail how the lid of the packing container engages with the top rim of the container body.
Figure 4:
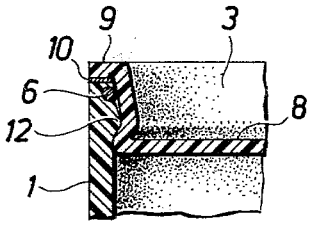

FIG. 4 corresponds to FIG. 3 but shows a further embodiment of the arrangement in accordance with the invention.

Figure 5:
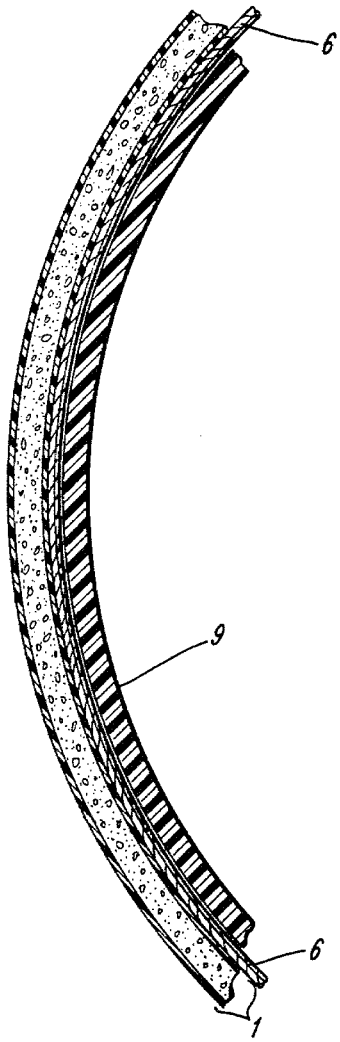

FIG. 5 shows a detail view of cross section taken through the tear thread.

The preferred embodiment of the packing container illustrated is manufactured from a laminated material which comprises a relatively thick carrier layer of foamed plastics which has attached to it on either side a relatively thin homogeneous layer of thermoplastic material, e.g. polyethylene or polystyrene. The material is mouldable by means of shrinkage induced by the effect of heat and can be sealed, in that at least the surface layer of the parts that are to be sealed together is heated to softening, whereupon the parts are pressed together.

Figure 1:
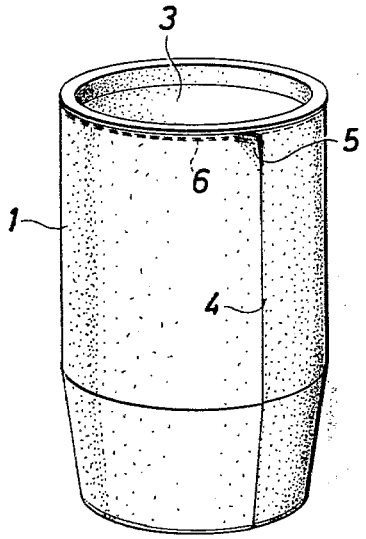
FIG. 1 shows a packing container in accordance with the invention in perspective presentation.
Figure 2:
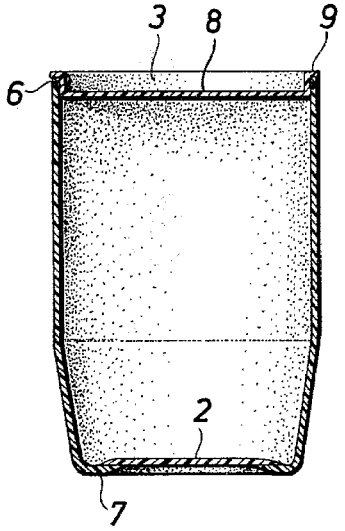
FIG. 2 shows the packing container in accordance with FIG. 1 in cross-section.

The packing container shown in FIG. 1 comprises a substantially tubular container body 1 which is provided with a base 2 (visible in FIG. 2). In the open top of the container body 1 there is a lid 3 attached to the container body which will be described in more detail in the following. The container body 1 is manufactured from a substantially rectangular material strip, the short ends of which are heat-sealed to each other and the packing container consequently has a vertical overlap joint 4 which extends over the whole height of the packing container. At the upper end of the joint 4 there is a lug 5, not attached to the underlying material layer, which projects from the overlap joint and substantially extends adjoining the underlying material. This lug 5 serves as a pulling lug for the opening of the packing container and is joined for this purpose to a tearing thread 6 located round the upper end of the packing container at a little distance below the rim or the lid 3 (FIG. 2). The tearing thread 6 is located in the inner homogeneous layer of the laminated material and therefore projects from the underside of the tearing lug 5 formed by the packing laminate. The base 2 situated at the bottom end of the container body 1 is joined along its periphery in a liquid-tight manner to an edge 7 of the container body 1 folded in underneath the base 2.

The lid 3 arranged in the upper open end of the container body 1 is manufactured from the same laminated material as the container body and by deep-drawing has been given a dished shape with a recessed inner portion 8 and a circumferential edge in the form of an outwardly folded flange 9. The recessed portion 8 comprises a substantially cylindrical part whose outside diameter corresponds to the inside diameter of the upper cylindrical end of the container body 1. The lid 3 is attached to the container body only through seal 10 of the butt-weld type joining together the flange 9 and the top rim of the container body 1, and the recessed portion 8 of the lid thus is not directly joined to the surrounding cylindrical part of the container body 1, but rests only with a grip-type fit against the same.

The fixing of the lid 3 and the design of the upper end of the container body 1 are evident more clearly from FIG. 3 which on a larger scale illustrates the said part of the packing container in accordance with FIG. 2. From the figure it can be seen clearly how the upper cylindrical part of the container body 1 is joined in a liquid-tight manner by means of the seal 10 to the outwardly folded flange 9 of the lid 3. It can also be seen how the tearing thread 6 is situated in the surface of the container body 1 facing towards the inside of the packing container at some distance below the rim of the container body 1, and how the recessed portion of the lid fits closely with its outer peripheral surface against the inner surface of the container body in an area indicated by reference numeral 11, at some distance below the tearing thread 6.

The construction of the container body and lid described makes it possible in a simple manner to open and to reclose the packing container. When the packing container is to be opened, the pulling lug 5 is gripped and with it also the end of the tearing thread 6 attached to it, so that pulling the lug causes the tearing thread 6 successively to cut through the wall of the container body 1 producing a cut running round the whole circumference of the container body which separates the lid 3, and the part of the container body 1 attached to the flange 9 of the lid and situated above the tearing thread 6, from the container body proper. Subsequently, the lid 3 (including the said part of the container body 1) can be lifted off the container body so that the contents become accessible for consumption. If it is desired to reclose the package, the recessed inner portion 8 of the lid is placed into the top end of the packing container, so that the close fit of the said part against the inner, cylindrical surface of the container body on the one hand serves as a guide and on the other hand provides a good seal and helps to retain the lid in the packing container. Owing to the fit between the top rim (produced by the opening with the tearing thread) of the container body and the part of the container body joined to the lid 3 it is ensured on the one hand that the lid is not replaced obliquely into the packing container and, on the other hand, that it is not pressed down too far into the same.

In the embodiment of the arrangement in accordance with the invention described here the peripheral edge of the recessed inner portion 8 of the lid is substantially cylindrical, and by the appropriate matching of the outside dimension of this portion and the inside dimension of the likewise cylindrical container body a smoothly gliding gripping fit can be obtained between the said parts producing good reclosability.

In large packing containers or in such cases where special demands are made on the tightness of the reclosed packing container, a second embodiment of the arrangement in accordance with the invention may be preferred. Such an embodiment is shown in FIG. 4 which similarly to FIG. 3 shows on a larger scale the attachment between the top edge of the container body and a lid 3. In this embodiment too the container body 1 is provided with an opening indication line with tearing thread 6 situated at a small distance below the seal 10, and immediately below this the container body 1 has an internal ridge 12 extending all round which serves as a snap-action closure device for the lid when the same, after the opening of the packing container is pressed down again into the top end of the container body. The bottom part 8 of the lid 3 is below the ridge 12 and the substantially cylindrical portion of the recessed part 8 has a recessing corresponding to the ridge 12. By matching the distance between the top rim (seal 10) of the container body and the bottom boundary of the ridge 12 with the distance between the flange 9 of the lid and the bottom end of the lid it becomes possible, making use of the inherent elasticity of the lid material, to bring about a relatively strong fit between the lid and the bottom part of the ridge 12.

The arrangement in accordance with FIG. 4 functions substantially as described in connection with FIG. 3, that is to say, after the lid 3 together with a narrow, annular top part of the container body 1 has been separated from the container body with the help of the tearing thread, it is possible to close the container again by replacing the lid into the upper end of the container body. Owing to the elasticity of the laminated packing material it becomes feasible to press the bottom end of the lid 3 past the ridge 12 so that the outer boundary surface of the recessed part 8 of the lid comes into close contact with the bottom part of the ridge. If the distance between the bottom end of the lid and the flange 9 of the lid is chosen a little smaller than the distance between the upper rim of the container body and the bottom part of the ridge 12 the edge of the lid situated between the flange 9 and the recessed part 8 will, owing to the flexibility of the material, serve as a spring and urge the recessed portion into contact against the ridge, which ensures exceptional tightness and safety against unintentional reopenings.

The ridge 12 as well as the groove in the lid 3 corresponding to the ridge can of course be made more or less marked depending upon the desired retaining force and tightness. Instead of a ridge extending round the container body it is also possible to provide a number of shorter ridges or warts limited in their length. The corresponding recess or groove on the lid may be formed in similar manner or it may be omitted altogether, since in most cases the elasticity of the material ensures satisfactory tightness and retaining force. A reverse construction is also possible of course, i.e. providing the lid with ridges or warts and designing the inside of the container body with a groove or recess.

In the embodiments described it is also possible, and in some cases, appropriate, to provide the recessed inner part 8 of the lid 3, with a conical outer edge or guiding surface which facilitates the reintroduction of the lid into the upper end of the container body.

The design with a tearing thread which breaks through the wall of the packing container at a little distance from the seal between the wall and the lid precludes any form of interference with the packing container or its contents, since each opening attempt leaves behind clear traces which cannot be concealed by renewed sealing. Other forms of tearing indications are also conceivable, e.g. weakening opening indication lines or the like, but the tearing thread described has proved very appropriate and easily openable. The tearing thread also produces a well-defined container edge and ensures that the opening occurs at the right place which is important if good reclosability is to be guaranteed. This is true especially in respect to the embodiment described in FIG. 4, where in fact the resulting tightness depends on the distance between the top edge of the contaier body and the recess part of the lid. The special combination of tearing indication or tearing thread and a lid with a recessed part in close fit with the inside of the container according to the invention thus provides a reclosable packing container of the non-returnable type which is safe and reliable and is of a simple construction well suited for automatic manufacture.

I claim:

1. A reclosable container, comprising:

a container body having a bottom, a top, and an inner surface with an upper portion;

a base connected to the bottom of the body;

a lid which is secured to the top of the body, a portion of which lid engages the upper portion of the inner surface of the body to form a tight fit;

a severable portion of the container body located above the upper portion of the inner surface of the container body, which severable portion, when severed, defines an opening of the container;

a tear thread arranged within an inner layer of the severable portion of the container body, adjacent the inner surface of the container body; and said lid being secured to the top of the body by a liquid tight bond.

2. Apparatus in accordance with claim 1 wherein the portion of the lid which engages the upper portion of the inner surface of the body includes at least one ridge.

3. Apparatus in accordance with claim 1 wherein the upper portion of the inner surface of the body includes at least one ridge.

4. Apparatus in accordance with claim 1 wherein said portion of said lid includes a central recessed portion, the shape of which central recessed portion substantially conforms to the shape of the upper portion of the inner surface of the body and which central recessed portion is sized to produce a tight fit when brought into engagement with the upper portion of the inner surface of the body.

5. Apparatus in accordance with claim 4 wherein the shapes of the central recessed portion and the upper portion of the inner surface of the body are cylindrical.

6. Apparatus in accordance with claim 1 wherein said lid includes a downwardly turned flanged sealed to a rim of the top of the container body.

7. Apparatus in accordance with claim 1 wherein said container is fabricated from a thermoplastic material.

8. Apparatus in accordance with claim 1 wherein said container is fabricated from a laminate which includes a central layer of foamed plastic material arranged between layers of homogeneous plastic material.

* * * * *